US005127202A

United States Patent [19]

Yokota et al.

[11] Patent Number: 5,127,202

[45] Date of Patent: Jul. 7, 1992

[54] EXTERNAL WALL OF BUILDING CONSTRUCTED BY PANEL UNITS

[75] Inventors: Teruo Yokota; Akihiko Takeda, both of Tokyo; Noriaki Okamoto; Hideyuki Yokoya, both of Kanagawa, all of Japan

[73] Assignee: Yoshida Kogyo K. K., Tokyo, Japan

[21] Appl. No.: 537,113

[22] Filed: Jun. 13, 1990

[51] Int. Cl.[5] ..... E04F 17/00

[52] U.S. Cl. ..... 52/235

[58] Field of Search ..... 52/235, 397, 403

[56] References Cited

U.S. PATENT DOCUMENTS

| | | | |
|---|---|---|---|
| 2,971,616 | 2/1961 | Bayley, Jr. | 52/235 X |
| 4,596,099 | 6/1986 | Kaminaga | 52/235 |
| 4,614,069 | 9/1986 | Tanikawa et al. | 52/235 |
| 4,619,092 | 10/1986 | Kaminaga | 52/235 |

FOREIGN PATENT DOCUMENTS

| | | | |
|---|---|---|---|
| 61-4570 | 2/1986 | Japan . | |
| 2141476 | 12/1984 | United Kingdom | 52/235 |
| 2141761 | 1/1985 | United Kingdom | 52/235 |

*Primary Examiner*—David A. Scherbel
*Assistant Examiner*—Michele A. Van Patten
*Attorney, Agent, or Firm*—Hill, Van Santen, Steadman & Simpson

[57] ABSTRACT

An exterior wall of a building, comprises: a plurality of panel units each of which is constructed of: a frame member constructed of a right and a left vertical member together with an upper and a lower lateral member horizontally interposed between the right and the left vertical member; and a plurality of panel members mounted on a front surface of the frame member in such a manner as to be parallelly spaced apart from each other by a predetermined joint space. The plurality of panel units are mounted on a front surface of the building through a plurality of mounting brackets in such a manner as to be parallelly spaced apart from each other by the same space as that of the joint space.

11 Claims, 19 Drawing Sheets

EXTERNAL WALL OF BUILDING CONSTRUCTED BY PANEL UNITS

BACKGROUND OF THE INVENTION

1. Field of the Invention

The present invention relates to an exterior wall of a building, which wall comprises a plurality of panel units mounted on a front surface of the building.

2. Description of the Prior Art

Hitherto, with respect to the exterior wall of the building comprising the panel units, for example, Japanese Utility Model Publication No. 61-4570 discloses a unit-type curtain wall.

In this unit-type curtain wall: a frame is mounted on a building through mounting brackets; and various type units mounted on a front surface of the frame, which unit comprises a first unit constituting an opening/closing window portion of the building and a second unit constituting a shoulder portion of the building, and constituting the exterior wall of the building.

As described above, the exterior wall of the building constructed of the various type units is good in appearance and workability. Consequently, it is possible for the various type units to improve the appearance of the building in design.

However, in construction of the exterior wall of the building constructed of the various type units, the various type units must be mounted on a front surface of the frame on a building site, the frame having been already mounted on the building through the mounting brackets. During the mounting operation, the frame and the individual units must be precisely positioned on the building site. However, it is very cumbersome for the building workers to conduct such a precise positioning work which takes too much time and labor. In addition, joint spaces formed between the units must be sealed on the building site. However, such a sealing work is very cumbersome and lacks reliability in water-tightness of the joint spaces. The above-mentioned disadvantages are combined to result in the fact that the exterior wall of the building constructed of the various type units is poor in workability and fails to establish a reliable water-tightness in the joint spaces.

Furthermore, with respect to the various type unit, since errors often occur in positioning of the individual units on the building site as described above, it is very difficult to coordinate the individual units with each other in appearance.

SUMMARY OF THE INVENTION

It is an object of the present invention to provide an exterior wall of a building, which wall is constructed of panel units to resolve the above disadvantages.

The above object of the present invention is accomplished by providing:

An exterior wall of a building, comprising:

a plurality of panel units each of which is constructed of: a frame member constructed of a right and a left vertical member together with an upper and a lower lateral member horizontally interposed between the right and the left vertical member; and a plurality of panel members mounted on a front surface of the frame member in such a manner as to be parallelly spaced apart from each other by a predetermined joint space; and the plurality of panel units being mounted on a front surface of the building through a plurality of mounting brackets in such a manner as to be parallelly spaced apart from each other by the same space as that of the joint space.

As for the number of steps of both of the positioning operation and the sealing operation of the panel units constituting the exterior wall of the present invention, that number of steps conducted in factories is larger than that number of steps conducted on the building site, which improves the exterior wall of the present invention in workability. In addition, the exterior wall of the present invention is also improved in water-tightness of the joint spaces adjacent to the panel units constituting the exterior wall of the present invention. Furthermore, the panel units of the exterior wall of the present invention may sufficiently coordinate with each other in appearance to improve the exterior wall of the present invention in appearance.

BRIEF DESCRIPTION OF THE DRAWINGS

The drawings show preferred embodiments of the present invention, wherein.

DESCRIPTION OF THE PREFERRED EMBODIMENTS

Hereinbelow, preferred embodiments of the present invention will be described in detail with reference to the accompanying drawings.

Figure 1:
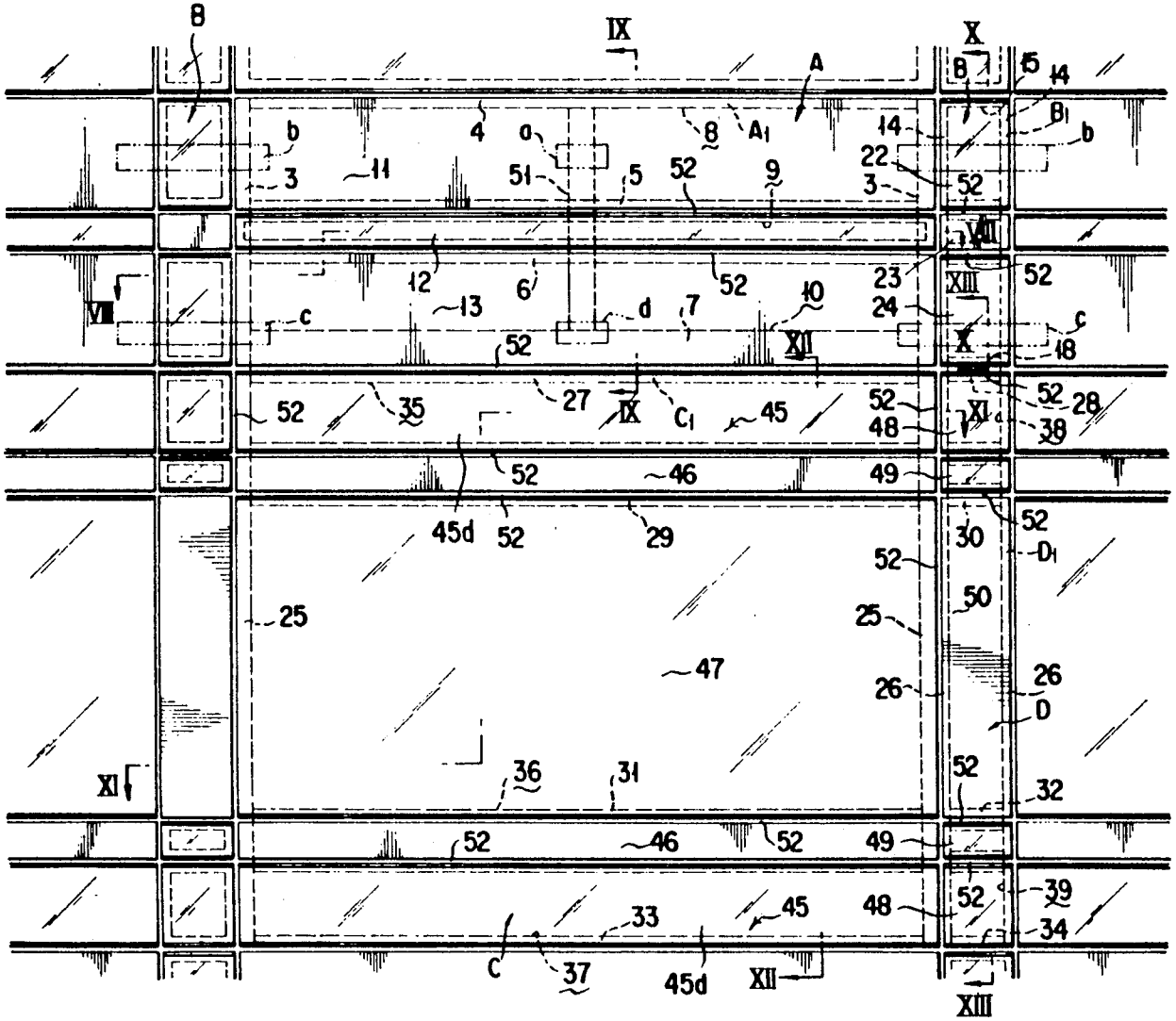
FIG. 1 is a partial front view of the exterior wall of the present invention of the building.
Figure 2:
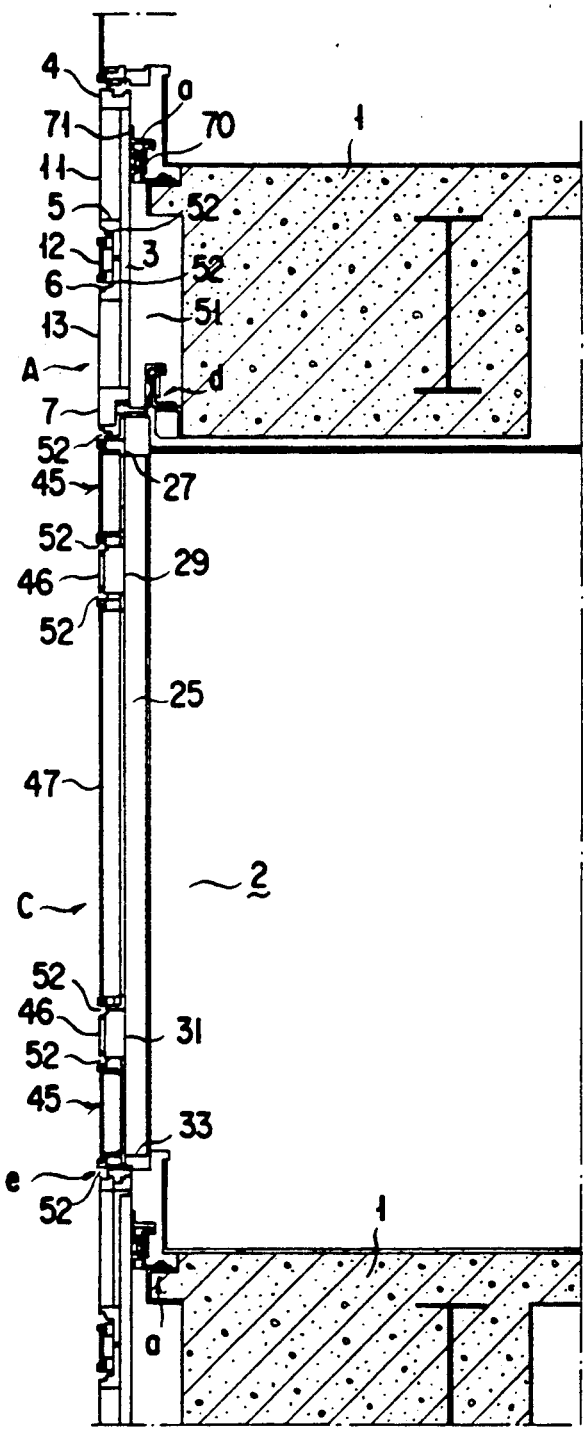
FIG. 2 is a longitudinal sectional view of the exterior wall of the present invention shown in FIG. 1.
Figure 3:
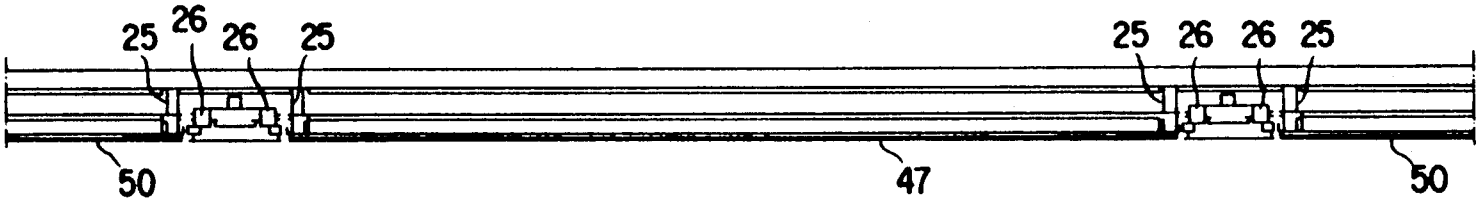
FIG. 3 is a cross-sectional view of the exterior wall of the present invention shown in FIG. 1.

As shown in FIGS. 1 and 2, a wide first panel unit "A" and a narrow second panel unit "B" are fixedly mounted on an exterior side of a slab 1 which constitutes a floor of a building to cover the exterior side of the slab 1. In addition, a wide third panel unit "C" and a narrow fourth panel unit "D" are fixedly mounted on an exterior side of an opening portion 2 of the building, which portion 2 is defined between an upper and a lower slab 1.

Figure 4:
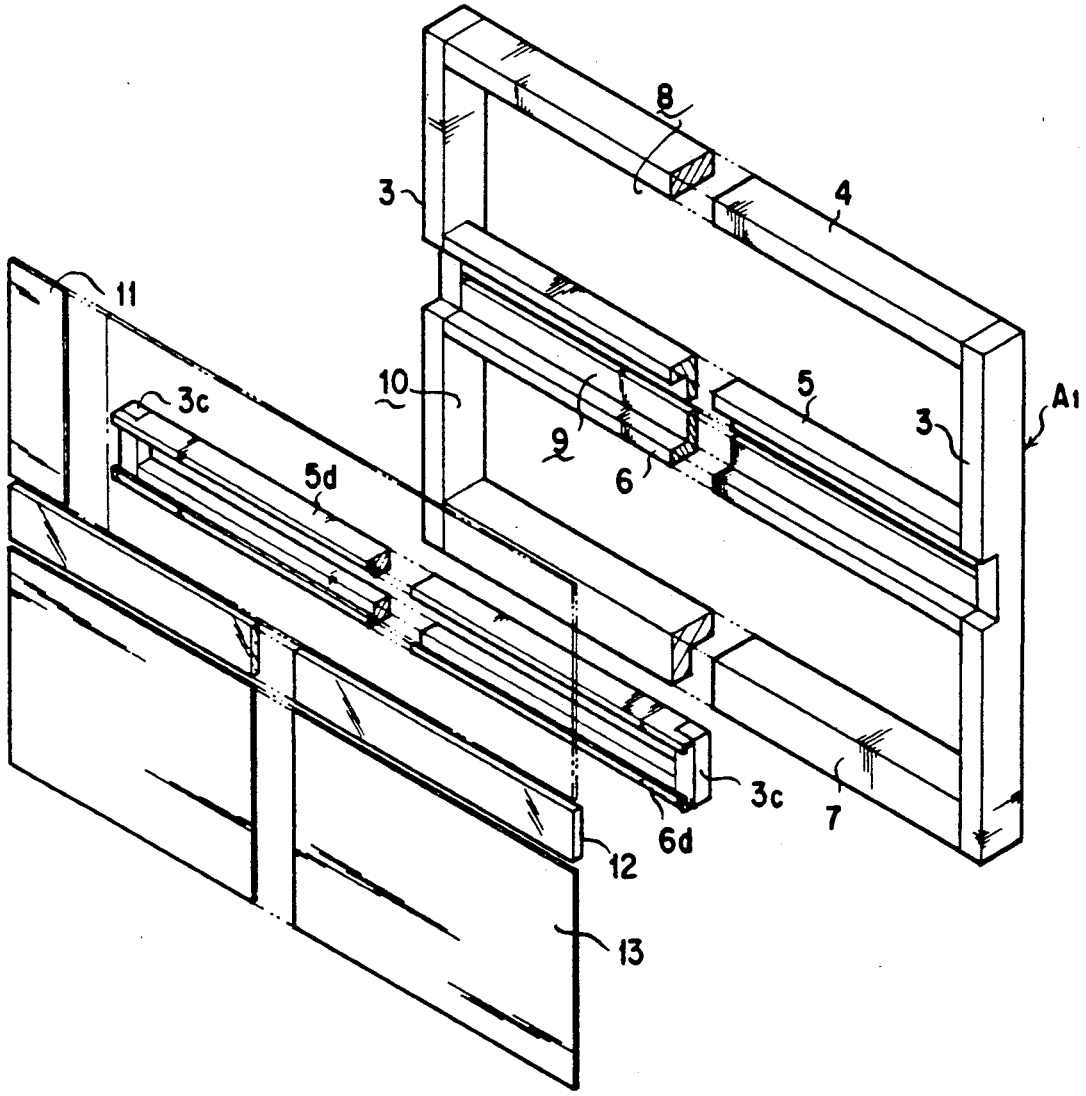
FIG. 4 is a schematic, disassembled perspective view of a first panel unit.

In the first panel unit "A", as shown in FIG. 4, horizontally disposed between a right and left vertical member 3 are: an upper lateral member 4; a first intermediate lateral member 5; a second intermediate lateral member 6; and a lower lateral member 7, so that a frame member $A_1$ provided with a first frame portion 8, a second frame portion 9 and a third frame portion 10 is formed. An aluminum panel 11, a glass panel 12 and an aluminum panel 13 are fixedly mounted on front surfaces of the first frame portion 8, second frame portion 9 through a glass panel receiving upper horizontal member 5*d*, a glass panel receiving lower horizontal member 6*d* and left and right glass panel receiving vertical members 3*c* and 3*c*, and the third frame portion 10 of the frame member $A_1$, respectively, in such a manner as to be parallelly spaced apart from each other by a predetermined joint space 52.

Figure 5:
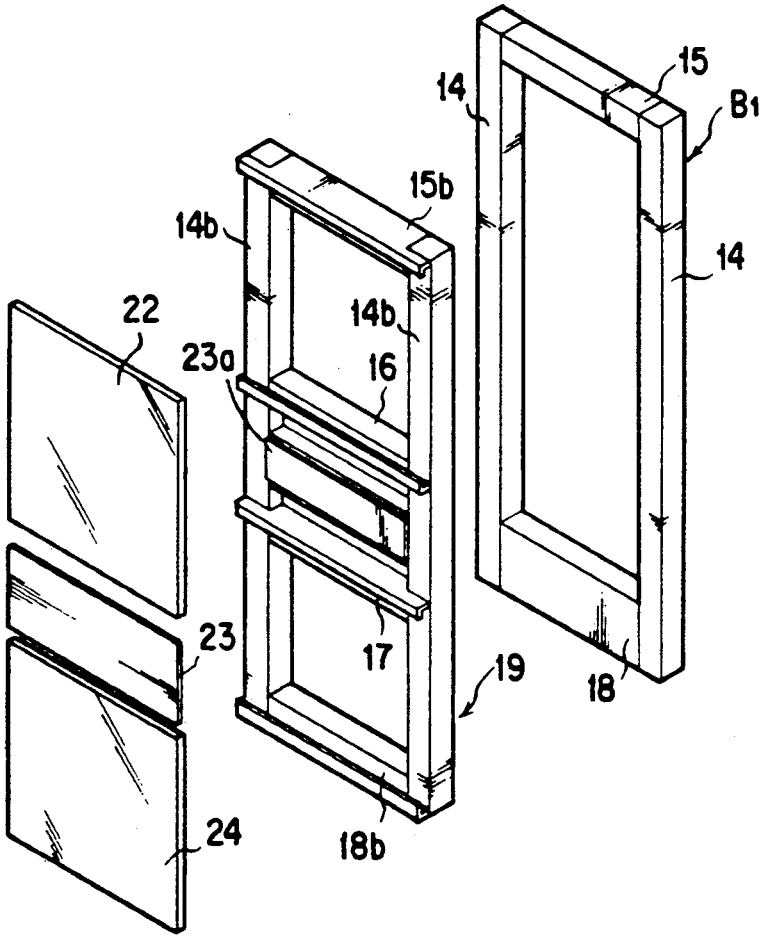
FIG. 5 is a schematic, disassembled perspective view of a second panel unit.

In the second panel unit "B", as shown in FIG. 5, horizontally disposed between a right and left vertical members 14 are: an upper lateral member 15 and a lower lateral member 18, so that a frame member $B_1$ is formed. A panel supporting uppermost lateral member 15*b* and a panel supporting intermediate lateral member 16 are connected to respective upper portions of and between a pair of left and right panel supporting vertical member 14*b*, 14*b* each having the same length as that of each vertical member 14, and a panel supporting intermediate lateral member 17 and a panel supporting lowermost lateral member 18*b* are connected to respective lower portions of and between the pair of vertical members 14*b*, 14*b*, and further a panel supporting plate 23*a* is connected between the panel supporting intermediate lateral member 16 and the panel supporting intermediate lateral member 17. Thus, a panel supporting frame 19 is formed. The pair of left and right glass panel supporting vertical members 14*b*, 14*b* of the panel supporting frame 19 are attached to respective outdoor surfaces of the pair of left and right vertical members 14, 14 of the frame member $B_1$, respectively. Between panel supporting members 15*b* and 16 and between panel supporting members 17 and 18*b* are mounted glass panels 22 and 24, respectively, and on the outdoor surface of the panel supporting plate 23*a* is mounted an aluminum panel 23, in such a manner as to be parallelly spaced apart from each other by the same joint space 52 as is formed in the above first panel unit "A".

Figure 6:
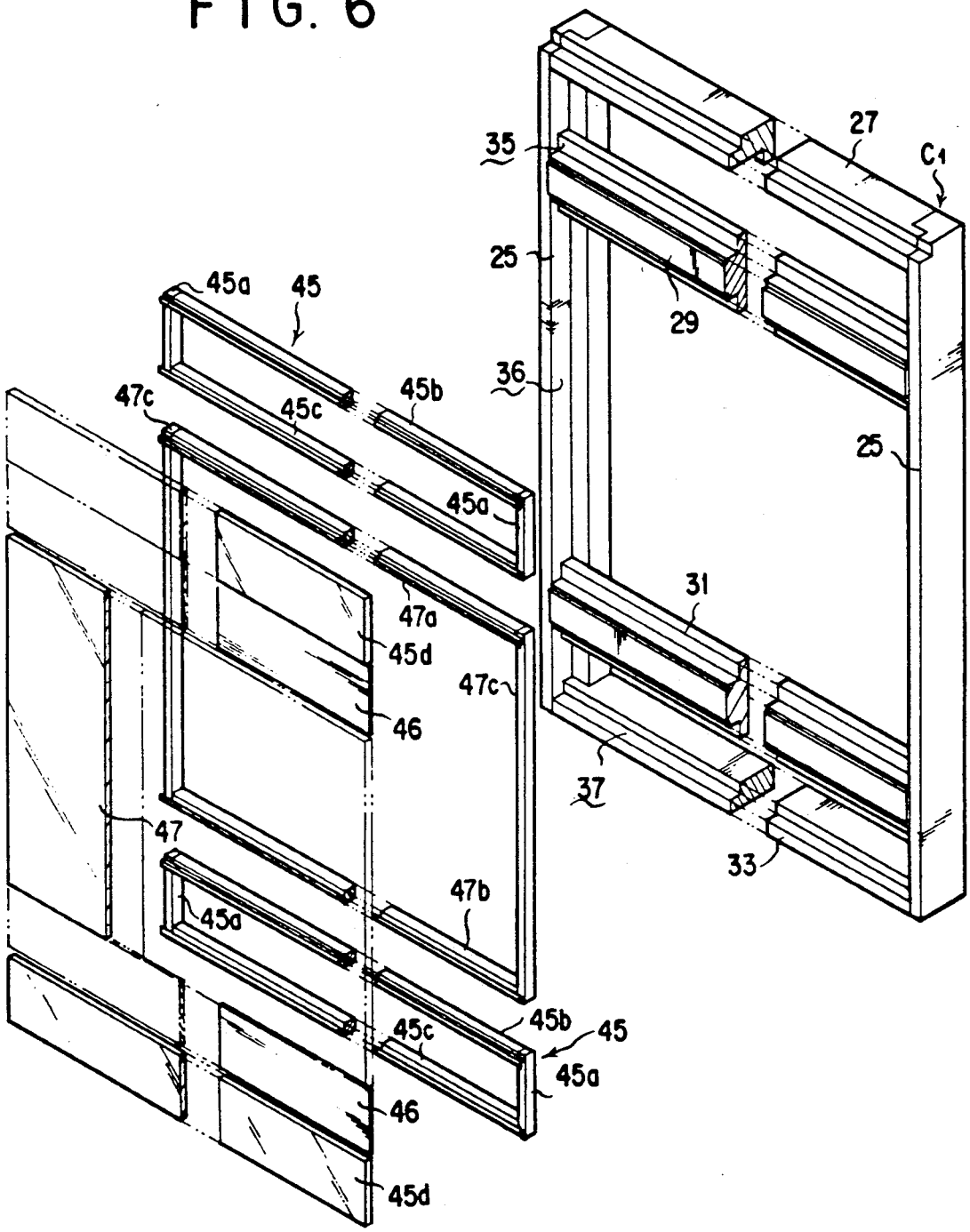
FIG. 6 is a schematic, disassembled perspective view of a third panel unit.

In the third panel unit "C", as shown in FIG. 6, horizontally disposed between a right and a left vertical members 25 are: an upper lateral member 27; a first intermediate lateral member 29; a second intermediate lateral member 31; and a lower lateral member 33, so that a frame member $C_1$ provided therein with a first frame portion 35, a second frame portion 36, a third frame portion 37 formed. Glass panel door 45, 45, aluminum panels 46, 46 and a glass panel 47 are fixedly mounted on respective front surfaces of the first and the third frame portions 35, 37, the first and the second intermediate lateral members 29, 31, and the second frame portion 36 through glass plate receiving upper and lower lateral members 47*b*, 47*a* and a pair of left and right glass plate receiving vertical members 47*c*, 47*c*, respectively, in such a manner as to be parallelly spaced apart from each other by a predetermined joint space 52, such as is found in the above first panel unit "A".

Each of the glass panel doors 45, 45 is made such that a glass panel 45*d* is mounted a rectangular frame formed with a pair of vertical stiles 45*a*, 45*a* and an upper rail 45*b* and a lower rail 45*c*.

Figure 7:
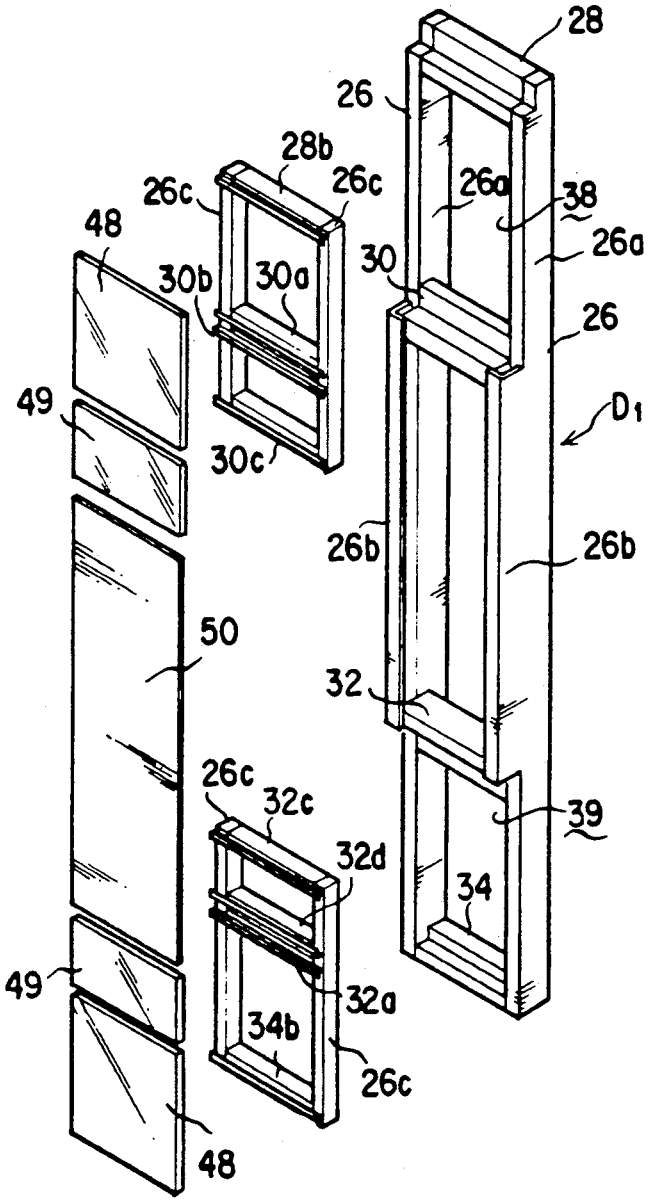
FIG. 7 is a schematic, disassembled perspective view of a fourth panel unit.

In the fourth panel unit "D", as shown in FIG. 7, horizontally disposed between a right and a left vertical member 26, 26 are: an upper lateral member 28; a first intermediate lateral member 30; a second intermediate lateral member 32; and a lower lateral member 34, so that a frame member $D_1$ provided therein with a first frame portion 38 formed between the upper lateral member 28 and the first intermediate lateral member 30 and with a second frame portion 39 formed between the second intermediate lateral member 32 and the lower lateral member 34 is formed. To the first frame portion 38 are fixedly mounted: a glass panel 48 through an upper glass receiving portion formed with a pair of left and right glass receiving vertical members 26*c*, 26*c* and a pair of upper and lower glass receiving lateral members 28*b*, 30*a* connected between the vertical members 26*c*, 26*c*; and a glass panel 49 through a first intermediate glass receiving portion formed by the pair of glass receiving vertical members 26*c*, 26*c* and a pair of upper and lower glass receiving lateral members 30*b*, 30*c* connected between the vertical members 26*c*, 26*c*, and to the second frame portion 39 are fixedly mounted: a glass panel 49 through a second intermediate glass receiving portion formed with a pair of left and right glass receiving vertical members 26*c*, 26*c* and a pair of upper and lower glass receiving lateral members 32*c*, 32*d* connected between the vertical members 26*c*, 26*c*; and a glass panel 48 through a lower glass receiving portion formed by the pair of glass receiving vertical members 26*c*, 26*c* and a pair of upper and lower glass receiving members 32*a*, 34*d* connected between the vertical members 26*c*, 26*c*, and further on the front surfaces of the first and the second intermediate lateral members 30, 32 is mounted an aluminum panel 50. Thus, the glass panels 48, 48 and 49, 49 and the aluminum panel 50 are parallelly spaced apart from one another by a predetermined joint space 52, such as is found in the above first panel unit "A".

As shown in FIGS. 1 and 2, a widthwise central portion of the frame member $A_1$ of the first panel unit "A" is fixedly mounted on the exterior side of the slab 1 through an intermediate rib 51 and a first mounting bracket "a" fixed to the rib 51. The right and the left vertical members 3 of the frame member $A_1$ of the first panel unit "A" and the right and the left vertical members 14 of the frame member $B_1$ of the second panel unit "B" are fixedly mounted on the exterior side of the slab 1 through second "b" and third "c" mounting brackets. An upper portion of each of the frame members $C_1$ and $D_1$ of the third "C" and the fourth "D" panel unit is fixedly mounted on the exterior side of the slab 1 through a fourth mounting bracket "d". On the other hand, a lower portion of each of the frame member $C_1$ and $D_1$ of the third "C" and the fourth "D" panel unit is fixedly mounted on an upper portion of each of the frame members $A_1$ and $B_1$ through a connecting piece "e". These panel units "A", "B", "C" and "D"" are parallelly spaced apart from each other by a predetermined joint space 52, as described above.

Components such as the vertical members 3, 14 and the upper 4, 15 and the lower 7, 18 members of the first "A" and the second "B" panel unit are equal in depth to each other so that a space for receiving each of the first "a", second "b", third "c" and the fourth "d" mounting bracket is formed between the exterior surface of the slab 1 and an interior surface of each of the above components. On the other hand, a depth of each of the first 5, 16 and the second 6, 17 intermediate lateral members is equal to a half of the depth of each of the vertical members 3, 14 so that the first 5, 16 and the second 6, 17 intermediate lateral members are fixedly mounted on the exterior sides of the right and the left vertical members 3, 14.

In the third "C" and the fourth "D" panel unit, a depth of each of the vertical members 25, 26, upper lateral members 27, 28 and the lower lateral members 33, 34 is equal to each other so as to be larger than that of each of the vertical members 3, 14 of the first "A" and the second "B" panel unit. On the other hand, a depth of each of the first 29, 30 and the second 31, 32 intermediate lateral members is substantially equal to a half of the depth of each of the vertical members 25, 26 so as to be fixedly mounted on the exterior sides of the vertical members 25, 26, whereby all the above glass and aluminum panels of the panel units "A", "B", "C" and "D" are flush with each other.

Now, the embodiments of the present invention will be specifically described in detail in construction.

Figure 8:
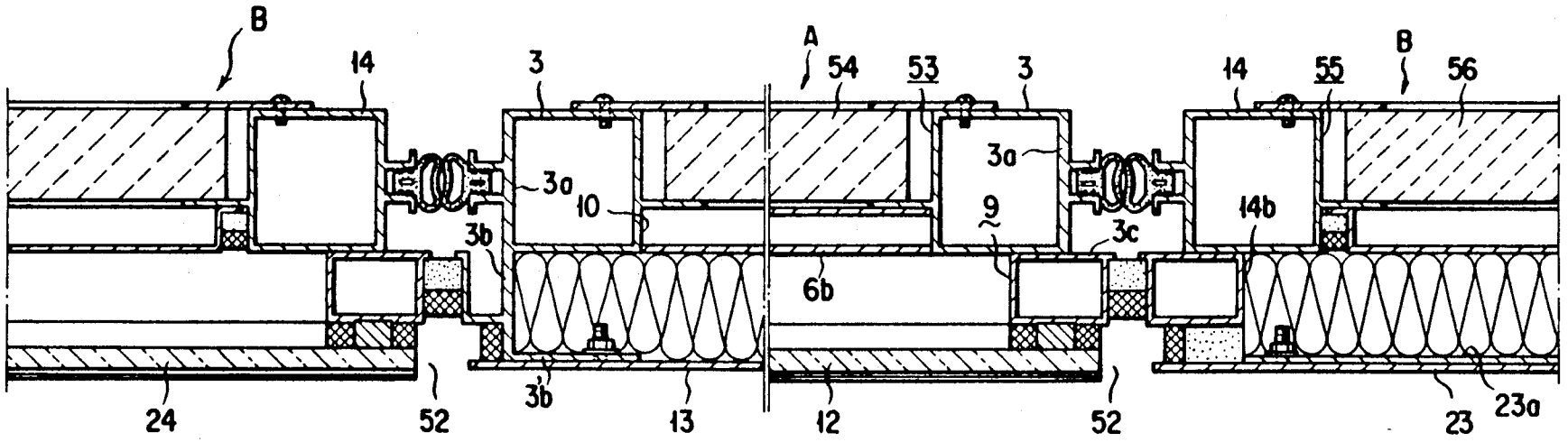
FIGS. 8, 9, 10, 11, 12 and 13 are sectional views taken along lines VIII—VIII, IX—IX, X—X, XI—XI, XII—XII and XIII—XIII in FIG. 1.
Figure 9:
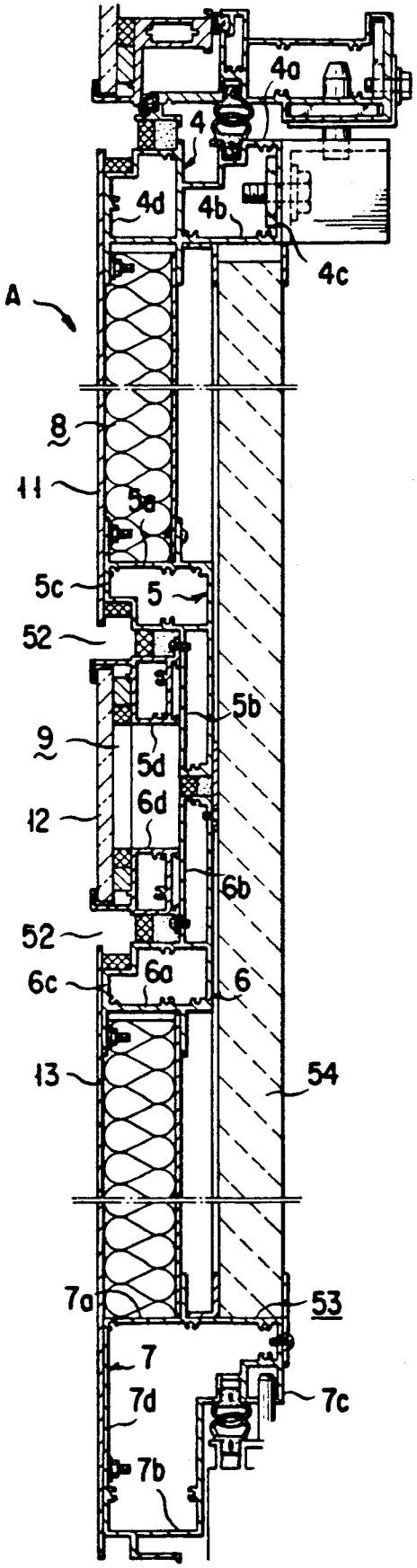

As shown in FIG. 8, the vertical member 3 is provided with a hollow main body 3*a* and a hook-like segment 3*b*. As shown in FIG. 9, the upper lateral member 4 of the first panel unit "A" is provided with an upper 4*a* and a lower 4*b* lateral plate portion and an interior-side 4*c* and an exterior-side 4*d* vertical plate portion to assume a substantially square-shaped hollow form. On the other hand, the first 5 and the second 6 intermediate lateral member are provided with main body portions 5*a* and 6*a* and a hollow projection portions 5*b* and 6*b*, respectively, the hollow projection portions 5*b* and 6*b* being integrally formed with interior sides of the main body portions 5*a* and 6*a*, respectively. The lower lateral member 7 is provided with an upper 7*a* and a lower 7*b* lateral plate portion and an interior - side 7*c* and an exterior-side 7*d* vertical plate portion to assume a substantially square-shaped hollow form. Each of these lateral members 4, 5, 6 and 7 abuts on the right and the left vertical members 3 and is connected therewith. The exterior-side vertical plates 4*d*, 5*d*, 6*c* and 7*d* of the upper lateral member 4, the first 5 and the second 6 intermediate lateral member and the lower lateral member 7 are flush with exterior-side parts 3'*b* of the hook-like segments 3*b* of the vertical members 3, so that the aluminum panel 11 is fixedly mounted on the exterior-side parts 3'*b* of the hook-like segments of the vertical members 3 and the exterior-side vertical plate portions 4*d* and 5*c* of the upper lateral member 4 and the first intermediate lateral member 5 to cover the exterior side of the first frame portion 8.

As shown in FIG. 8, the hook-like segments 3*b* of the vertical members 3, which are oppositely disposed from the second frame portion 9, are eliminated. In place of the thus eliminated hook-like segments 3*b*, glass-receiving vertical members 3*c* are provided. On the other hand, as shown in FIG. 4, an upper 5*d* and a lower 6*d* glass-receiving member are fixedly mounted on the projection portions 5*b* and 6*b* of the first 5 and the second intermediate lateral member. An upper and a lower edge portions of the glass panel 12 are received in the upper 5*d* and the lower 6*d* glass-receiving member, respectively. As shown in FIG. 4, a right and a left vertical edge interior side of the glass panel 12 are adhesively fixed to respective outdoor surfaces of the glass-receiving vertical members 3*c*.

The aluminum panel 13 is fixedly mounted on the exterior-side vertical plate portion 6*c* of the second intermediate lateral member 6, exterior-side vertical plate portion 7*d* of the lower lateral member 7 and the exterior-side parts 3'*b* of the hook-like segments 3*b* of the vertical members 3 to cover these members.

As shown in FIGS. 8 and 9, the interior sides of the vertical members 3 and those of the upper 4 and the lower 7 lateral member extend toward the interior of the building beyond the first 5 and the second 6 intermediate lateral member to form an interior-side square-shaped frame portion 53 in which a fire-resisting panel 54 is fixedly mounted.

Now, the second panel unit "B" will be described with reference to FIGS. 8 and 10.

Now, the second panel unit "B" will be described with reference to FIGS. 8 and 10.

The vertical member 14 is, as shown in FIG. 8, formed in a hollow body which is similar in shape to the hollow main body 3*a* of the vertical member 3 of the first panel unit "A". The upper and the lower lateral members 15, 18 are, as shown in FIG. 10, formed in hollow-shaped bodies, respectively, each having the same width as that of the vertical member 14 and connected between the left and the right vertical members 14, 14 by butting thereagainst so as to form the frame member $B_1$. The aforementioned panel supporting uppermost, intermediate and lowermost lateral members 15*b*, 16, 17 and 18*b* have a substantially same sectional shape and are connected between the pair of left and right glass panel supporting vertical members 14*b*, 14*b* by butting thereagainst. The upper and the lower edges of the glass panel 22 are supported by respective outdoor sides of the panel supporting uppermost and intermediate lateral members 15*b*, 16 and, on the other hand, the left and the right vertical side edge surfaces thereof on the indoor side fixedly adheres to respective outdoor surfaces of the pair of left and right glass panel supporting vertical members 14*b*, 14*b*, respectively. In the intermediate portion formed between the panel supporting intermediate lateral members 16, 17 and on the outdoor surfaces of the vertical members 14, 14 is fixedly mounted a horizontally extending and substantially C-shaped panel supporting frame 23*a* on which the aluminum panel 23 is mounted. The left and the right side edges of the panel 23 extend to the pair of left and the right glass panel supporting vertical members 14*b*, 14*b*, as shown in FIG. 8, so as to adhere thereto, respectively.

Figure 10:
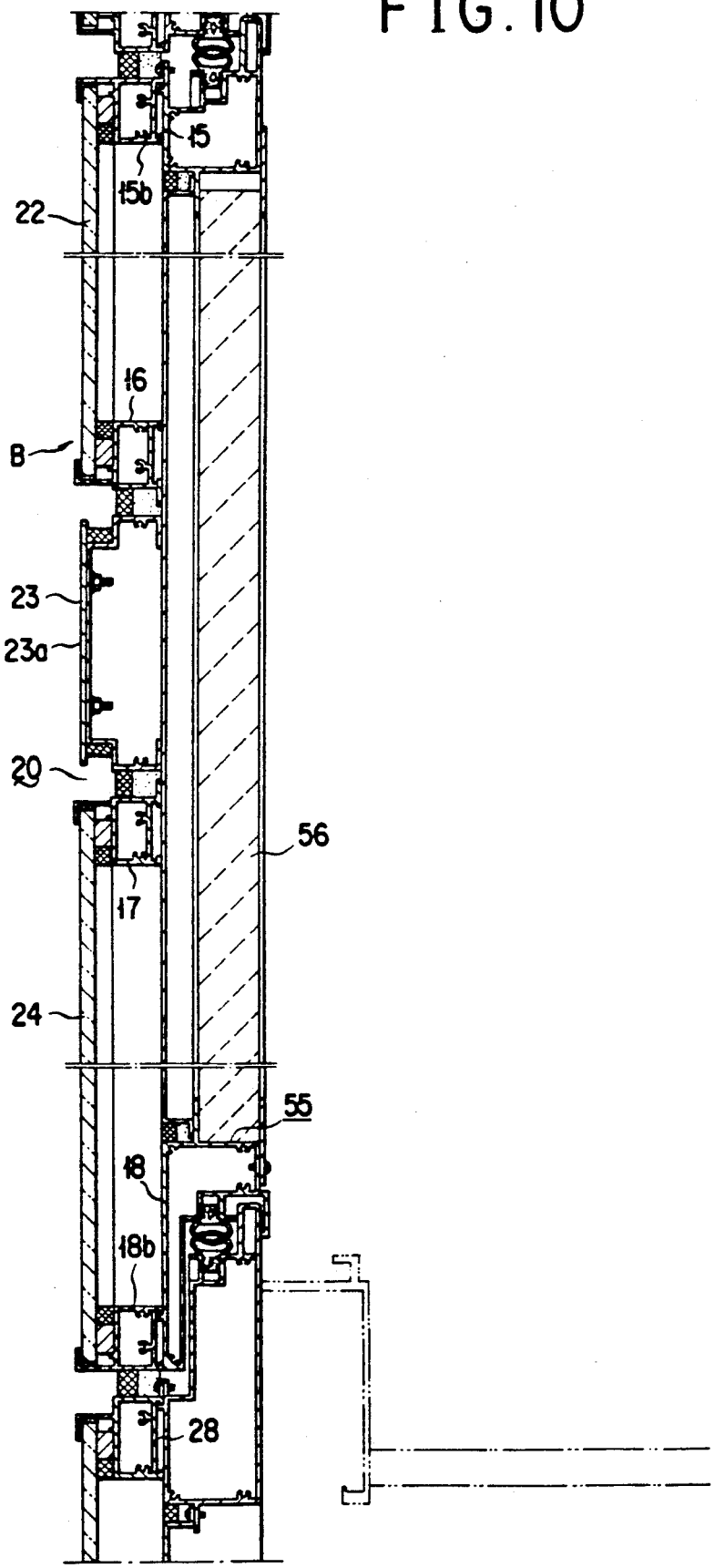

As shown in FIG. 10, the upper and the lower edges of the glass panel 24 are respectively supported by respective outdoor-side parts of the panel supporting intermediate and lowermost lateral members 17, 18*b* and, on the other hand, the left and the right vertical side edge surfaces thereof on the indoor side fixedly adhers to respective outdoor surfaces of the pair of left and right glass panel supporting vertical members 14*b*, 14*b*, respectively.

Further, the pair of left and right vertical members 14, 14 and the upper and the lower lateral members 15, 18 are combined to form an indoor-side square-shaped frame portion 55 to which a fire-resisting panel 56 is fixedly mounted, as shown in FIG. 10.

Now, the third panel unit "C" will be described hereinafter with reference to FIGS. 11 and 12.

Figure 11:
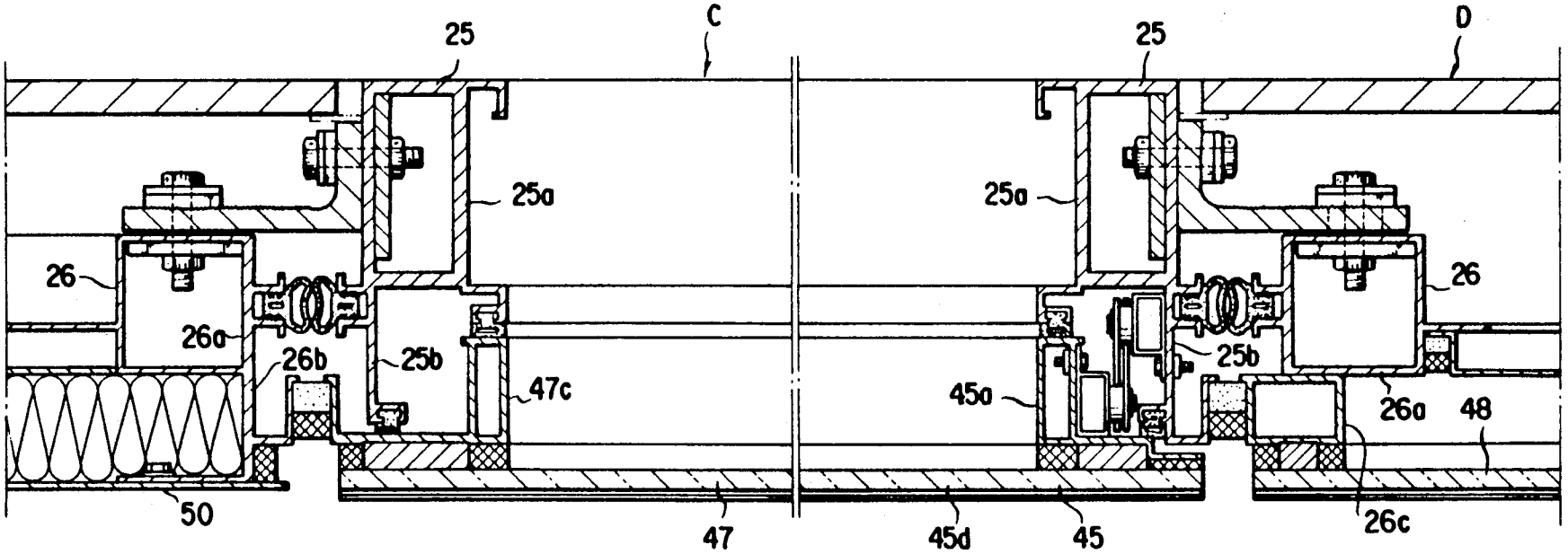

As shown in FIG. 11, the vertical member 25 is provided with a hollow main body 25*a* and a supporting segment 25*b*. On the other hand, as shown in FIG. 12, the upper lateral member 27 is provided with: a substantially C-shaped interior side main body 27*a* which opens downward; and a hollow exterior side supporting portion 27*b*. The first 29 and the second 31 intermediate lateral members are provided with: substantially L-shaped upper supporting portions 29*a* and 31*a*; lower supporting portions 29*b* and 31*b*; and vertical plate-like panel supporting portions 29*c* and 31*c*, respectively, to assume substantially C-shaped forms in cross section. The lower lateral member 33 is provided with an interior-side hollow main body 33*a* and an exterior-side supporting segment 33*b*. The upper 27 and the lower 33 lateral member abut on the vertical members 25 so as to be connected therewith. On the other hand, the first 29 and the second 31 intermediate lateral members abut on the supporting segments 25*b* of the vertical members 25 so as to be connected therewith.

Figure 12:
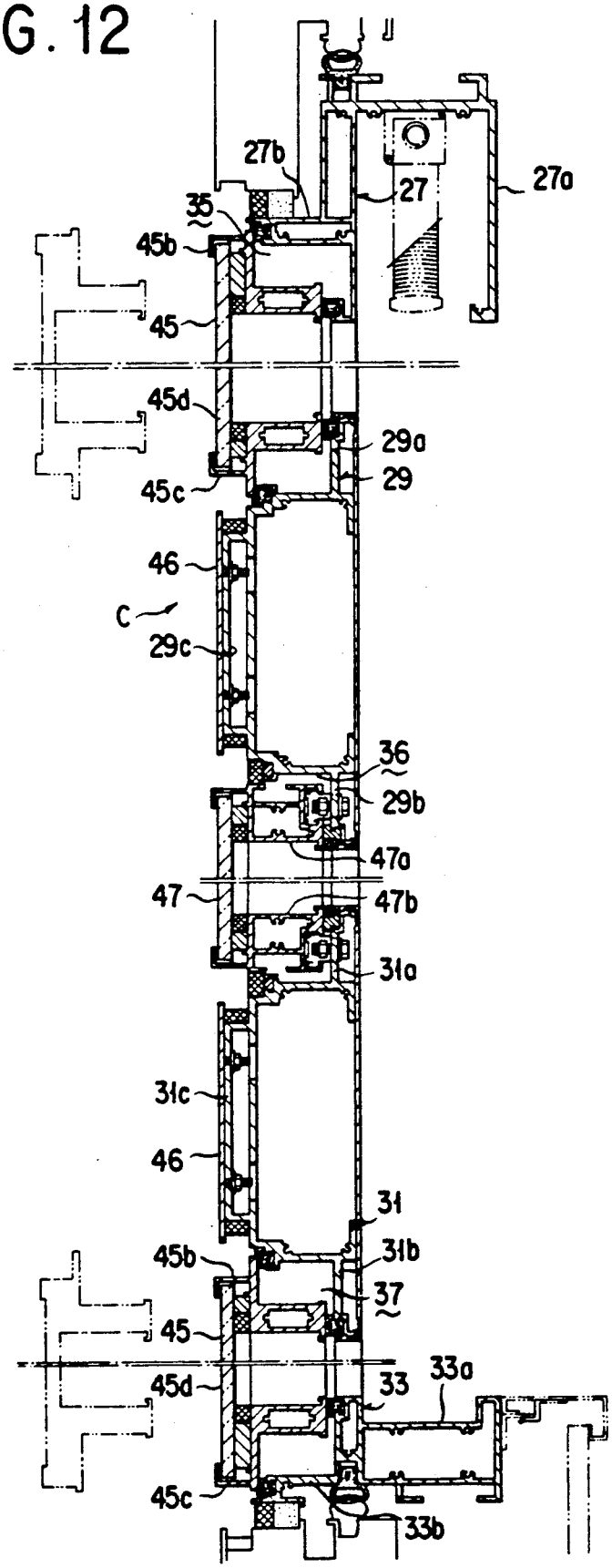

As shown in FIGS. 11 and 12, the glass panel 45 is constructed of a glass panel 45*d* and a panel frame consisting of vertical frame members 45*a* and an upper 45*b* and a lower 45*c* frame member, in which panel frame the glass pane is fixedly mounted. Namely, an upper and a lower edge portion of the glass pane 45*d* are supported by the upper 45*b* and the lower 45*c* frame member of the panel frame, while interior surfaces of a right and a left vertical edge portion of the glass panel 45*d* are adhesively fixed to the right and the left vertical frame members 45*a* of the panel frame. The glass panel 45 is fixedly mounted on each of the first 35 and the fifth 43 frame portion so as to parallelly extend toward the exterior side of the building.

The aluminum panel 46 is fixedly mounted on the panel supporting portions 29*c* and 31*c* of the first and the second intermediate lateral members 29, 31. The upper and the lower edges of the aforementioned glass panel 47 are respectively supported by respective outdoor-side parts of the glass plate receiving upper and lower lateral members 47*a*, 47*b* as shown in FIG. 12 and, on the other hand, the left and the right vertical side edge surfaces thereof on the indoor side fixedly adheres to respective outdoor surfaces of the pair of left and right glass panel receiving vertical members 47*c*, respectively, as shown in FIG. 11. The glass panel receiving upper lateral member 47*a* is fixedly secured through bolts to the lower supporting portion 29*b* of the first intermediate lateral member 29, and the glass panel receiving lower lateral member 47*b* is fixedly secured through bolts to the upper supporting portion 31*a* of the second intermediate lateral member 31, as shown in FIG. 11. Each of the glass panel receiving vertical members 47*c* extends laterally beyond the vertical member 25 and is adhesively fixed through a sealing member to a main body 25*a* and a supporting piece 25*b* of the vertical member 25.

Now, the fourth panel unit "D" will be described in detail with reference to FIGS. 11 and 13.

Figure 13:
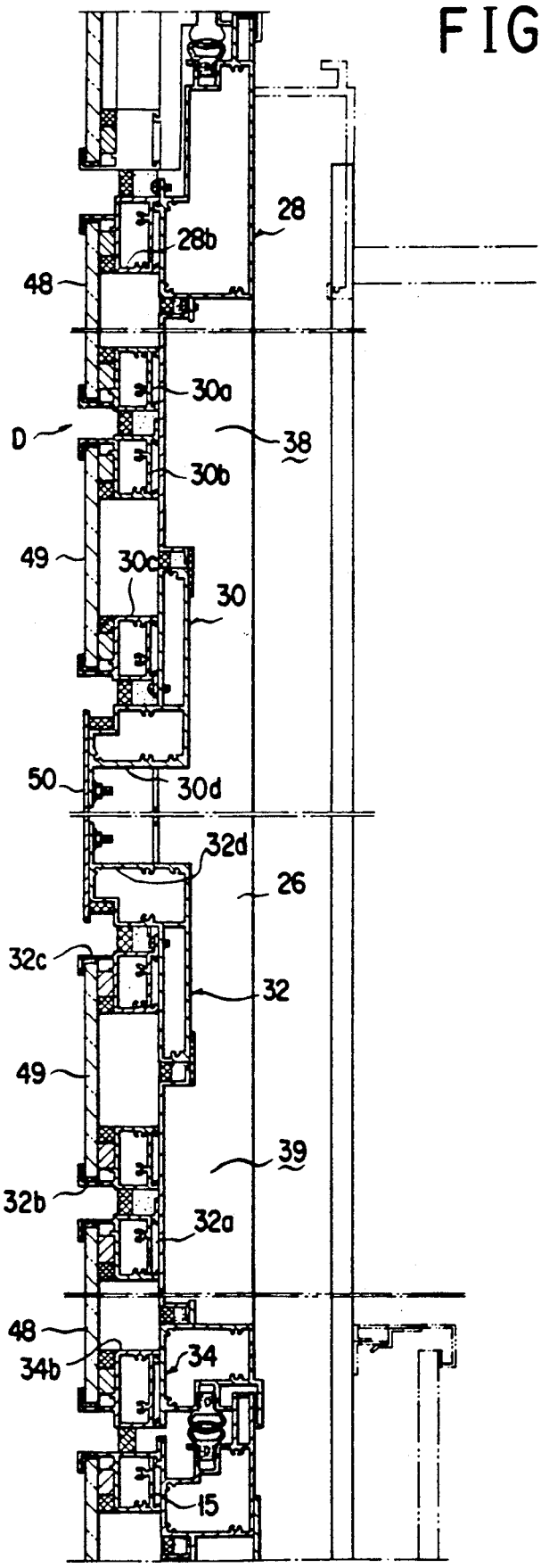

As shown in FIGS. 11 and 13, the vertical member 26 is provided with a hollow main body 26*a* adjacent to an exterior-side supporting frame 26D. In the supporting frame 26*b*, its upper and lower parts oppositely facing the first and the second frame portions 38, 39 are cut off. The upper and the lower lateral members 28, 34 are formed in a hollow shape having the same width as that of the hollow main body 26*a* of the vertical member 26 and connected between the pair of left and right main body 26*a* by butting thereto. The first and the second intermediate lateral members 30, 32 are formed in an L-hollow shape in cross section and inverted vertically so as to connected between the pair of left and right main body 26*a* of the vertical member 26 by butting thereto. Further, respective outdoor parts of the intermediate lateral members 30, 32 are projected to the outside to form a frame member $D_1''$.

Still further, respective upper and the lower edges of the glass panels 48, 48 are supported between the pair of upper and the lower glass receiving lateral members 28*b*, 30*a* and between the pair of upper and lower glass receiving lateral members 32*a*, 34*b*, respectively. On the other hand, the left and the right side-edges on the indoor side of each of the glass panels 48, 48 are adhesively fixed to the respective outdoor-side surfaces of the pair of left and the right glass receiving vertical members 26*c*, 26*c* as shown in FIG. 13. Respective upper and the lower edges of the glass panels 49, 49 are supported between the pair of upper and lower glass receiving lateral members 30*b*, 30*c* and between the pair of upper and lower glass receiving lateral members 32*c*, 32*d*, respectively. On the other hand, the left and the right side-edges on the indoor side of each of the glass panels 49, 49 are adhesively fixed to the respective outdoor-side surfaces of the pair of left and the right glass receiving vertical members 26*c*, 26*c*. The aluminum panel 50 is fixedly interposed between the respective outdoor-side main bodies 30*d*, 32*d* of the first and the second intermediate lateral members 30, 32 and between the left and right supporting pieces 26*b*, 26*b* of the vertical member 26.

Figure 14:
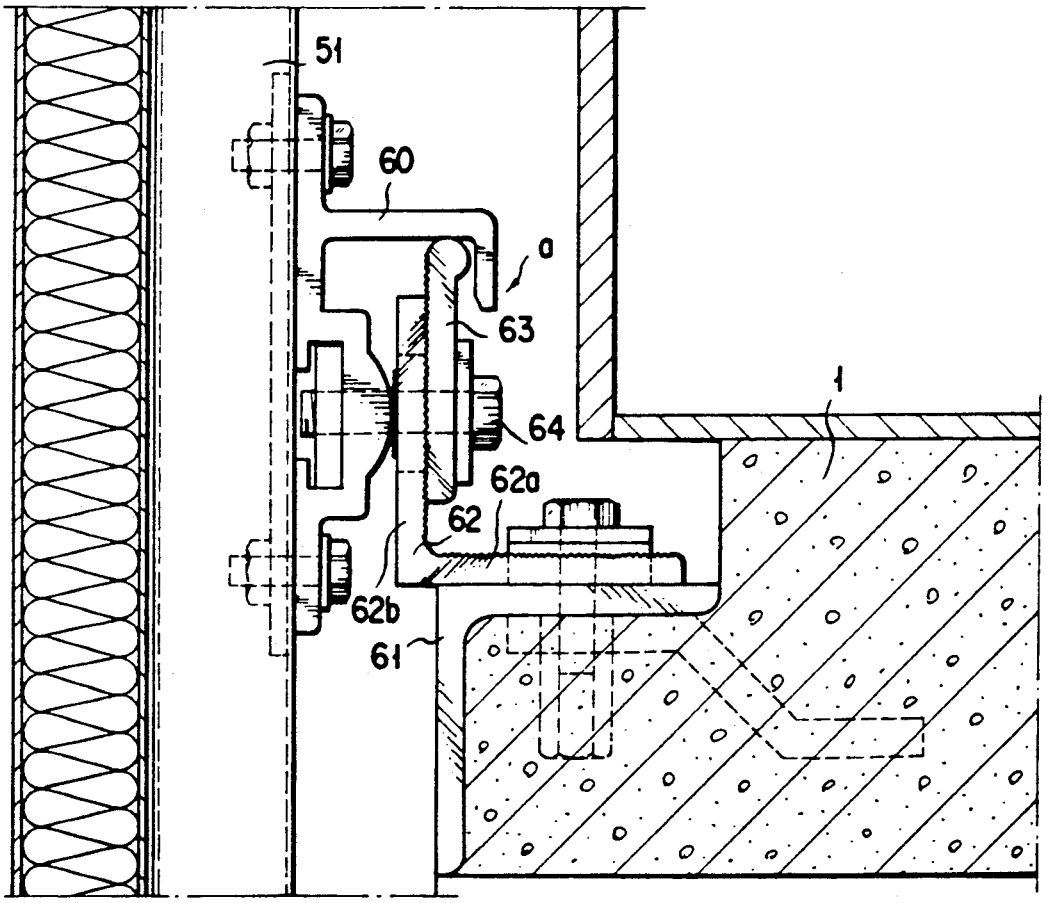
FIG. 14 is a longitudinal sectional view of a first mounting bracket employed in the exterior wall of the present invention shown in FIG. 1.
Figure 15:
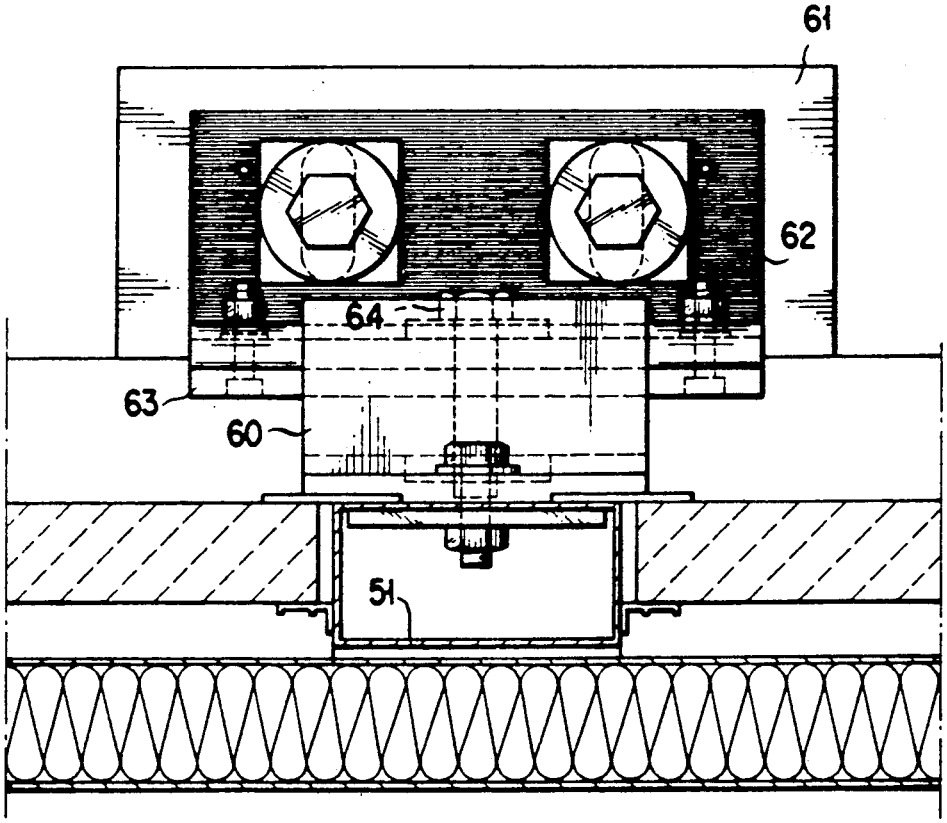
FIG. 15 is a plan view of the first mounting bracket employed in the exterior wall of the present invention shown in FIG. 1.

As shown in FIGS. 14 and 15, the first mounting bracket "a" is provided with: a hook 60 fixedly mounted on the intermediate rib 51; a first 61 and a second 62 L-shaped fastener; and a supporting plate 63. The first fastener 61 is fixed to the slab 1. On the other hand, a lateral piece 62*a* of the second fastener 62 is bolted to the first fastener 61. The supporting plate 63 is mounted on a vertical piece 62*b* of the second fastener 62 so as to be vertically adjustable in position relative to the vertical piece 62*b* of the second fastener 62, whereby the supporting plate 63 abuts on the hook 60.

Incidentally, the second mounting bracket "b" is similar in shape to the first mounting bracket "a", so that the second mounting bracket "b" is provided with the first 61 and the second 62 fastener and the hook 60, which fasteners 61 and 62 span a space between the vertical members 3 and 14 of the first "A" and the second "B" panel unit. On the other hand, the hook 60 is bolted to the vertical members 3 and 14.

Figure 16:
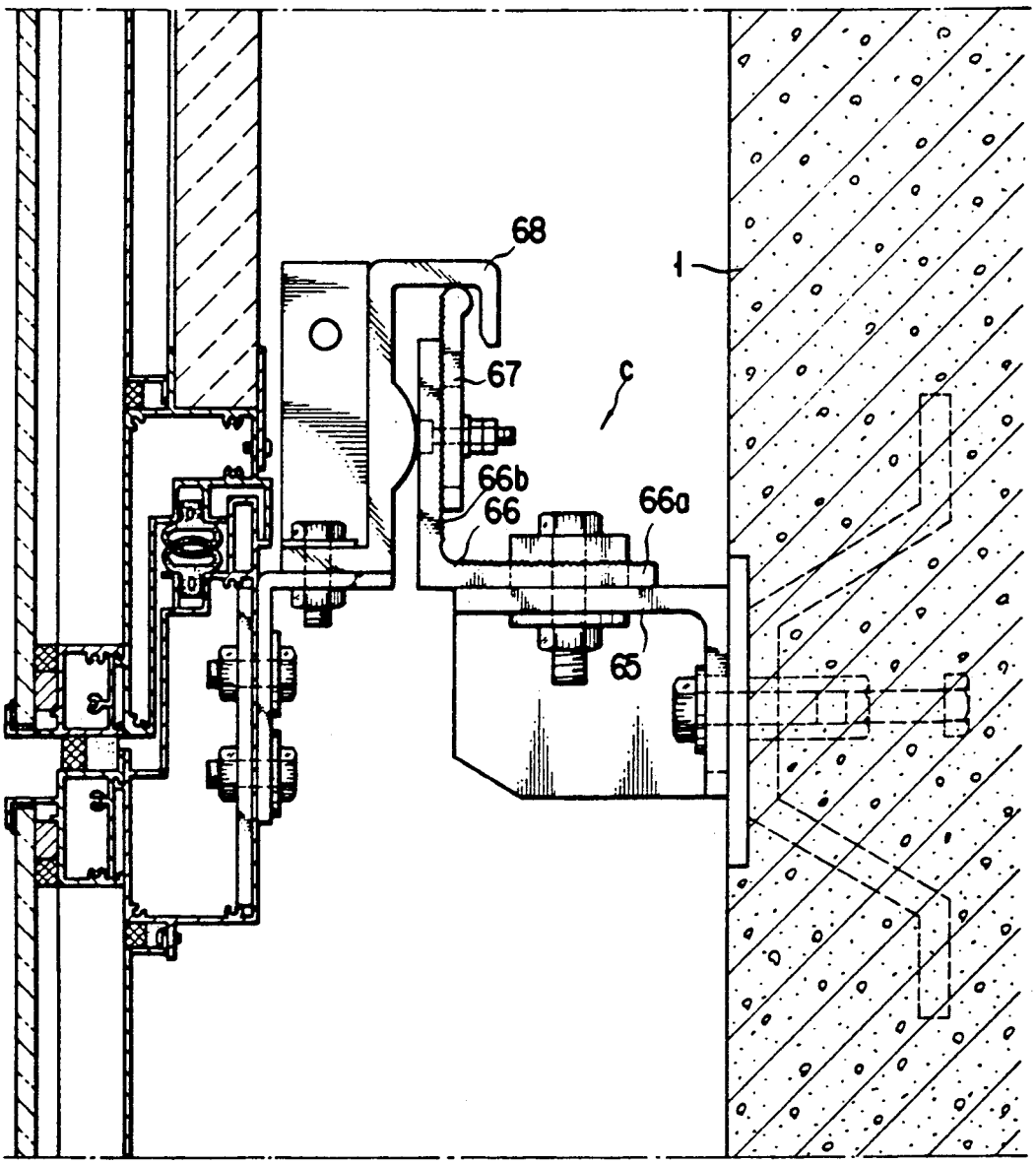
FIG. 16 is a longitudinal sectional view of a third mounting bracket employed in the exterior wall of the present invention shown in FIG. 1.
Figure 17:
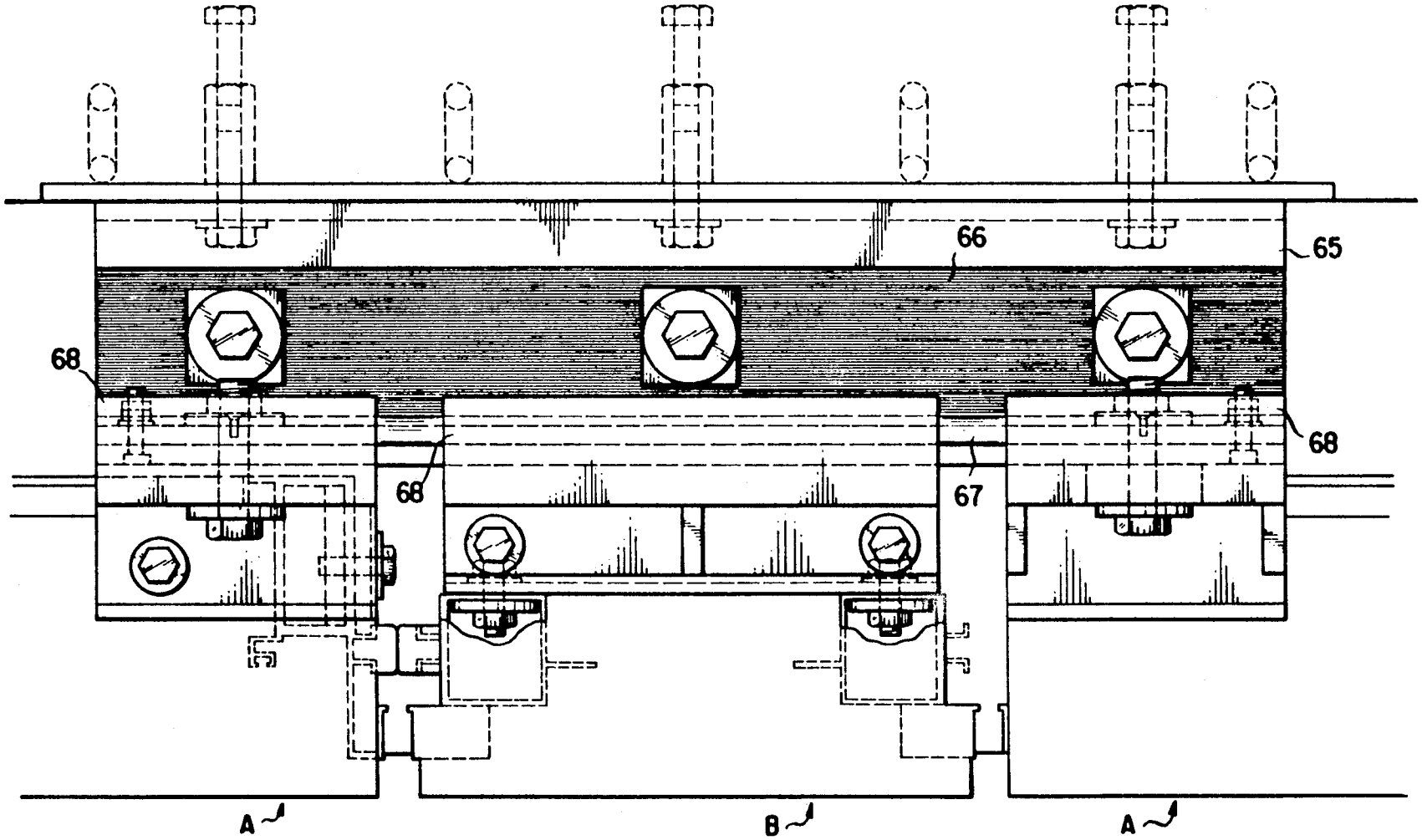
FIG. 17 is a plan view of the third mounting bracket employed in the exterior wall of the present invention shown in FIG. 1.

As shown in FIGS. 16 and 17, in the third mounting bracket "c", a lateral piece 66*a* of a second fastener 66 is bolted to a first fastener 65 which is fixedly mounted on the slab 1. On the other hand, to a vertical piece 66*b* of the second fastener 66 is bolted a supporting plate 67 which is adjustable in position relative to the vertical piece 66*b* of the second fastener 66 as is clear from FIG. 16. Hooks 68 is fixedly mounted on lower portions of the frame members $A_1$ and $B_1$ of the first "A" and the second "B" panel unit, so that the hooks 68 engages with the supporting plate 67.

Figure 18:
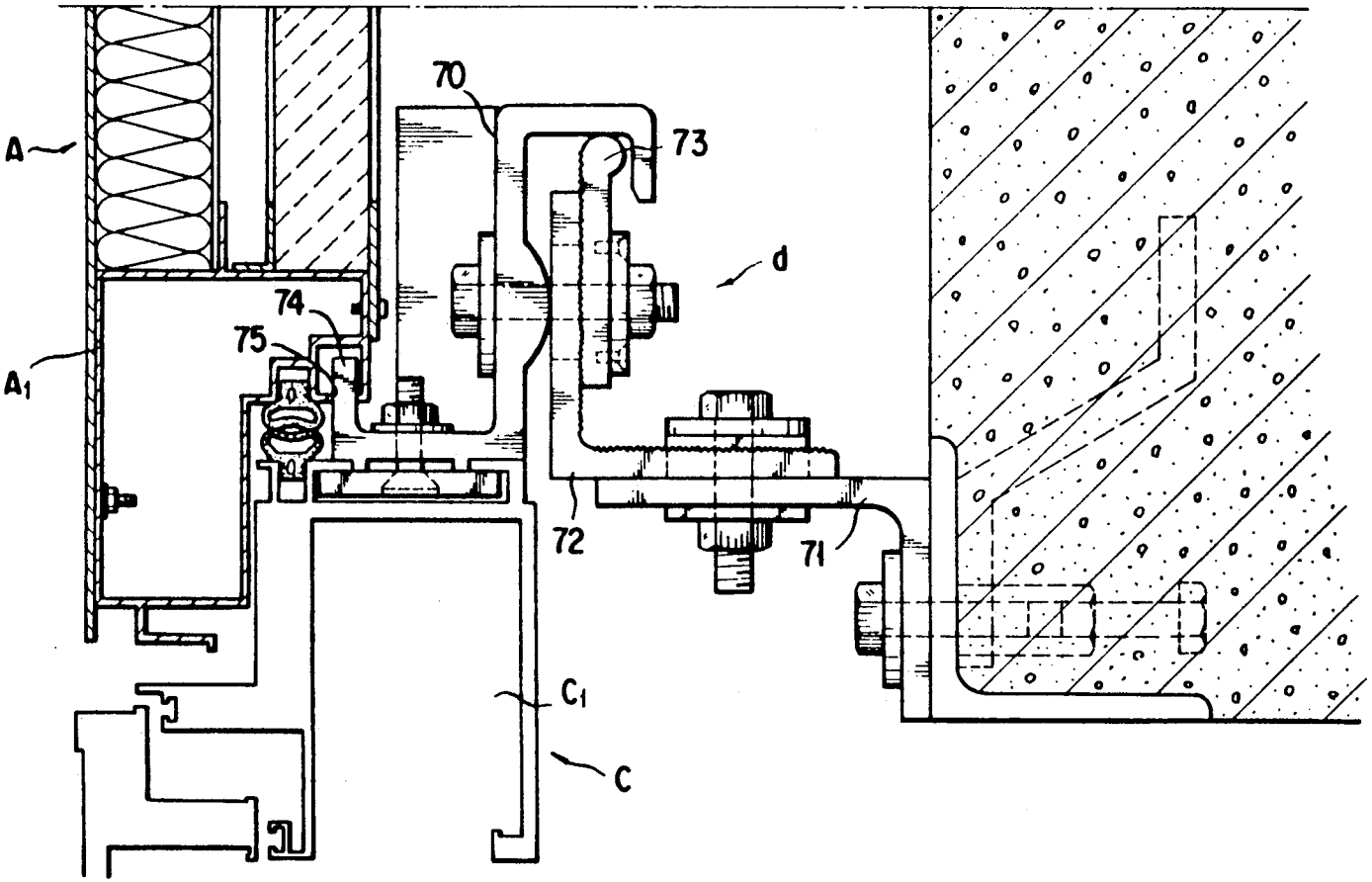
FIG. 18 is a longitudinal sectional view of a fourth mounting bracket employed in the exterior wall of the present invention shown in FIG. 1.
Figure 19:
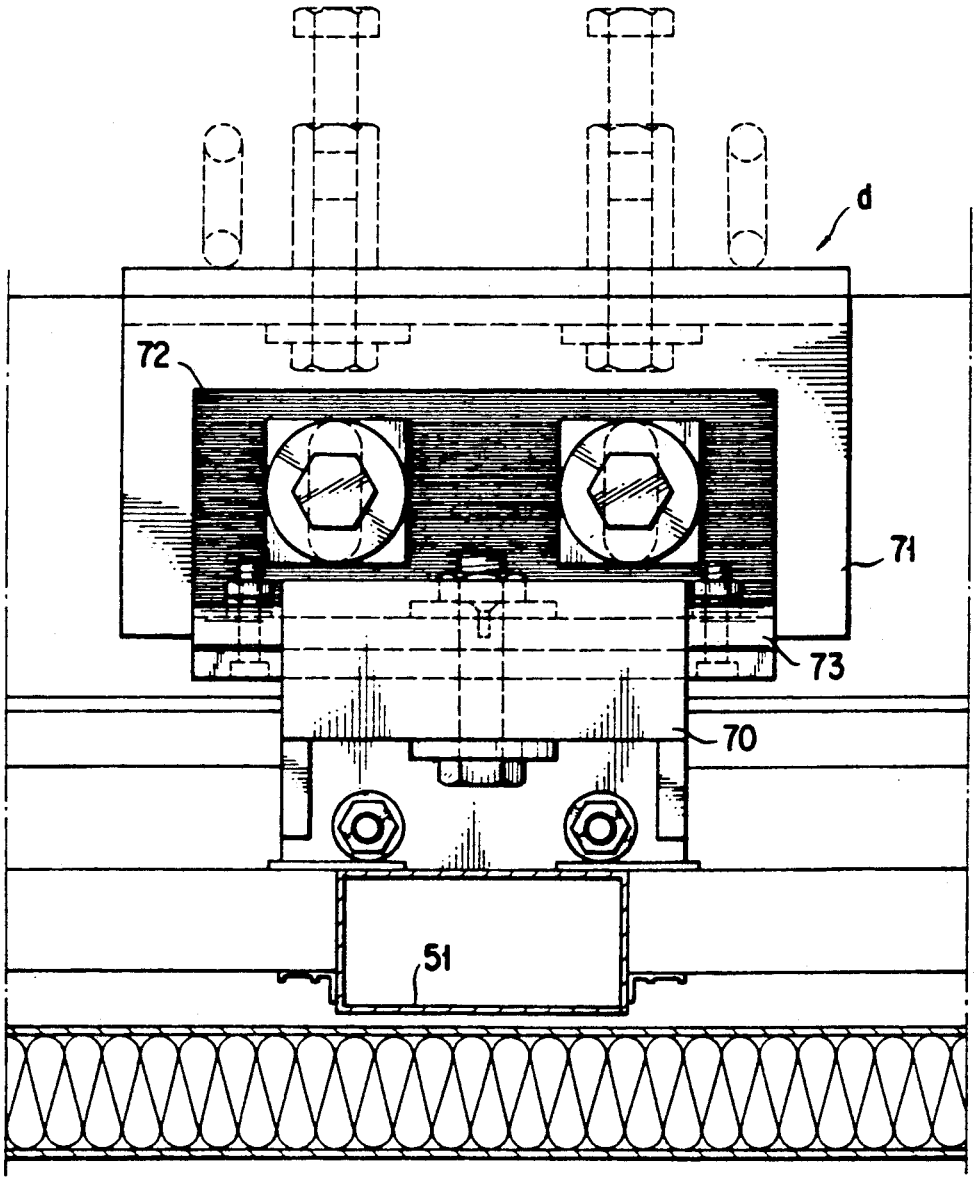
FIG. 19 is a plan view of the fourth mounting bracket employed in the exterior wall of the present invention shown in FIG. 1.

As shown in FIGS. 18 and 19, the fourth mounting bracket "d" is provided with: a hook 70 fixedly mounted on an upper portion of the frame member $C_1$ of the third panel unit "C"; a first fastener 71 fixedly mounted on the slab 1; a second fastener 72 bolted to the first fastener 71; and a mounting plate 73 so mounted on the second fastener 72 as to be adjustable in position relative to the second fastener 72. A projection piece 74 of the hook 70 engages with a concave portion 75 formed in a lower portion of the frame member $A_1$ of the first panel unit "A", so that the lower portion of the frame member $A_1$ is connected with the fourth mounting bracket "d".

In the above embodiment of the present invention, a plurality of the panel units varying in shape are employed. However, it is also possible for the exterior wall of the present invention to employ a plurality of panel units assuming the same shape such as a rectangular shape and a square shape, which panel units may be fixedly mounted on the frame members through the mounting brackets.

Since, in the exterior wall of the present invention of the building, the panel units are previously constructed of a plurality of the panel members fixedly mounted on the frame members so as to be parallelly spaced apart from each other by the predetermined joint space, it is possible to precisely construct the panel units in the factories in such a manner as to have its panel members parallelly spaced apart from each other by the predetermined joint space. In addition, it is also possible to seal the joint spaces of the panel units with a suitable sealing material in the factories. Therefore, the panel units of the present invention are easily constructed in the factories to make it possible to coordinate the panel members of the panel units in appearance and to improve the panel units in water-tightness.

As described above, the panel units of the present invention having been already constructed in the factories are mounted on a front surface of the building so as to be parallelly spaced apart from each other by the same joint space as that of the panel members. Consequently, on the building site, the panel units of the present invention is simply positioned and mounted on the building, and only the joint spaces between the panel units are sealed with the sealing material on the building site to construct the exterior wall of the building. Therefore, it is possible for the panel units of the present invention to considerably reduce the number of steps of the positioning work and the sealing work of the panel units conducted on the building site, which leads to improvements in workability of the panel units, in water-tightness of the joint spaces of the panel units and in appearance of the exterior wall of the building.

Since many changes and modifications can be made to the above-described construction without departing from the spirit of the present invention, it is intended that all matters given in the above description and illustrated in the accompanying drawings shall be interpreted to be illustrative only and not as a limitation to the scope of the present invention.

What is claimed is:

1. An exterior wall of a building, comprising:

(a) a plurality of rectangular panel units combined with one another on a front surface of a building wall in vertical and lateral directions, each of said panel units being constituted of a rectangular frame member formed with a pair of left and right vertical members spaced apart from each other together with upper, intermediate and lower lateral members horizontally interposed between said pair of vertical members, and a plurality of panel members each being mounted on a front surface of said frame member in such a manner as to be parallelly spaced apart from one another by a predetermined joint space forming a flush surface; and (b) a plurality of adjustable fittings each having a vertically extendable support plate for mounting said plurality of rectangular panel units on a front surface of the building and maintaining a panel spacing equivalent to said predetermined joint space.

2. An exterior wall as set forth in claim 1 wherein each of said pair of left and right vertical members comprises a hollow main body having a substantially rectangular shape in cross section and positioned on an indoor side of said building wall, and a hook-like segment integrally formed with said hollow main body so as to project therefrom to an outdoor side of said exterior wall, said hook-like segment providing a mounting surface for mounting a panel member directly onto an outside surface thereof.

3. An exterior wall as set forth in claim 1 wherein each of said upper, intermediate and lower lateral members comprises a hollow main body having a substantially rectangular shape in cross section and a panel mounting vertical plate integrally formed with said hollow main body and positioned on an outdoor side of said exterior wall so as to allow said panels mounted thereon to form a flush surface.

4. An exterior wall as set forth in claim 1 wherein at least a piece of a glass panel is mounted on said exterior wall through a glass panel supporting frame constituted of a plurality of glass receiving members mounted on an outdoor side of a frame portion defined by said pair of left and right vertical members, said upper lateral member and said intermediate lateral member.

5. An exterior wall as set forth in claim 1 wherein a fire-resisting panel is mounted within an indoor-side rectangular shaped frame portion surrounded by said pair of left and right vertical members, said upper lateral member and said lower lateral member.

6. An exterior wall as set forth in claim 1, wherein at least a piece of a glass panel is mounted on said exterior wall through a glass panel supporting frame constituted of a plurality of glass receiving members mounted on an outdoor side of a frame portion defined by said pair of left and right vertical members, a first intermediate lateral member and a second intermediate lateral member.

7. An exterior wall as set forth in claim 1, wherein at least a piece of a glass panel is mounted on said exterior wall through a glass panel supporting frame constituted of a plurality of glass receiving members mounted on an outdoor side of a frame portion defined by said left and right vertical members, said intermediate lateral member and said lower lateral member.

8. An exterior wall of a building, comprising:

(a) a plurality of rectangular panel units combined with one another on a front surface of a building wall in vertical and lateral directions, each of which being constituted of a rectangular frame member formed with a pair of left and right vertical members spaced apart from each other together with upper, intermediate and lower lateral members horizontally interposed between said pair of vertical members and a plurality of panel members each being mounted on a front surface of said frame member in such a manner as to be parallelly spaced apart from one another by a predetermined joint space and forming a flush surface; and (b) a plurality of fittings for mounting said plurality of rectangular panel units on a front surface of the building; and (c) wherein at least a piece of aluminum panel is mounted on said exterior wall through a plurality of panel supporting members integrally projected on the outdoor side from a frame portion defined by said pair of left and right vertical members, said upper lateral member and said intermediate lateral member.

9. An exterior wall of a building constituted of a plurality of rectangular panel combinations, each of which being combined with a plurality of rectangular panel units, mounted on a front surface of said building in such a manner as to be parallelly spaced apart from one another by a predetermined joint space and to form a flush surface wherein each of said panel combinations comprises:

(a) a first wide panel unit mounted through fittings on an outer wall of a first slab of the building;

(b) a second narrow panel unit mounted through fittings on the outer wall of the slab and disposed at one lateral side of said first wide panel unit apart therefrom by the predetermined joint space;

(c) a third wide panel unit mounted through fittings on an outer wall of a second slab of the building so as to form an exterior wall outside a space formed between a pair of slabs adjacent in the vertical direction to each other and disposed just under said first wide panel unit apart therefrom by the predetermined joint space; and (d) a fourth narrow panel unit mounted through fittings on an outer wall of said second slab and disposed at one lateral side of said third wide panel unit apart therefrom by the predetermined joint space and just under said second narrow panel unit apart therefrom by the predetermined joint space; and wherein each of said panel units comprises:

(1) a pair of left and right vertical members spaced apart from each other, each of which being comprised of a substantially rectangular hollow main body and a hook-like segment integrally formed with said main body so as to project therefrom to the outdoor side of said exterior wall;

(2) upper and lower lateral members, each of which being comprised of a substantially rectangular hollow main body and interposed horizontally between said pair of left and right vertical members by butting thereagainst at each end thereof;

(3) at least an intermediate lateral member comprised of a substantially rectangular hollow main body and interposed horizontally between said pair of left and right vertical members by butting thereagainst at each end thereof;

(4) a frame members comprised of said pair of vertical members, said upper and said lower lateral members and said intermediate lateral members; and (5) a plurality of panels mounted directly on said frame member or through a plurality of panel supporting and receiving members independent of said frame member so as to form a flush surface.

10. An exterior wall of a building, comprising:

(a) a plurality of rectangular panel units combined with one another on a front surface of a building wall in vertical and lateral directions, each of which being constituted of a rectangular frame member formed with a pair of left and right vertical members spaced apart from each other together with upper, intermediate and lower lateral members horizontally interposed between said pair of vertical members and a plurality of panel members each being mounted on a front surface of said frame member in such a manner as to be parallelly spaced apart from one another by a predetermined joint space and forming a flush surface; and (b) a plurality of fittings for mounting said plurality of rectangular panel units on a front surface of the building; and (c) wherein at least a piece of aluminum panel is mounted on said exterior wall through a plurality of panel supporting members integrally projected on the outdoor side from a frame portion defined by said pair of left and right vertical members, a first intermediate lateral member and a second intermediate lateral member.

11. An exterior wall of a building, comprising:

(a) a plurality of rectangular panel units combined with one another on a front surface of a building wall in vertical and lateral directions, each of which being constituted of a rectangular frame member formed with a pair of left and right vertical members spaced apart from each other together with upper, intermediate and lower lateral members horizontally interposed between said pair of vertical members and a plurality of panel members each being mounted on a front surface of said frame member in such a manner as to be parallelly spaced apart from one another by a predetermined joint space and forming a flush surface; and (b) a plurality of fittings for mounting said plurality of rectangular panel units on a front surface of the building; and (c) wherein at least a piece of aluminum panel is mounted on said exterior wall through a plurality of panel supporting members integrally projected on the outdoor side from a frame portion defined by said left and right vertical members, said intermediate lateral member said lower lateral member.

* * * * *